US011737543B2

(12) United States Patent
Bronold

(10) Patent No.: US 11,737,543 B2
(45) Date of Patent: Aug. 29, 2023

(54) HANDS TO FEET/PAWS TO CLAWS

(71) Applicant: Susan Marie Bronold, El Cajon, CA (US)

(72) Inventor: Susan Marie Bronold, El Cajon, CA (US)

(73) Assignee: Susan Marie Bronold, El Cajon, CA (US)

( * ) Notice: Subject to any disclaimer, the term of this patent is extended or adjusted under 35 U.S.C. 154(b) by 50 days.

(21) Appl. No.: 17/530,798

(22) Filed: Nov. 19, 2021

(65) Prior Publication Data

US 2023/0157433 A1 May 25, 2023

(51) Int. Cl.
*A45D 29/02* (2006.01)

(52) U.S. Cl.
CPC ..... *A45D 29/023* (2013.01)

(58) Field of Classification Search
CPC ..... A45D 29/023
USPC ..... 30/28
See application file for complete search history.

(56) References Cited

U.S. PATENT DOCUMENTS 2,620,560 A * 12/1952 Bahr ..... A45D 29/023 30/28
5,829,628 A * 11/1998 Lount ..... A45D 29/22 220/900
6,367,482 B1 * 4/2002 Baltheiser ..... A45D 29/023 132/75
2011/0061668 A1 * 3/2011 Saenim ..... A45D 29/023 30/28
2014/0026915 A1 * 1/2014 Darjania ..... A45D 29/00 132/73
2016/0324293 A1 * 11/2016 Wheeler ..... A45D 29/023
2020/0345120 A1 * 11/2020 Nisi ..... A45D 29/023

* cited by examiner

*Primary Examiner* — Omar Flores Sanchez
(74) *Attorney, Agent, or Firm* — Edison Law Group

(57) ABSTRACT

Disclosed is a clipped nail-catching and nail-capturing system consisting essentially of a nail clipper in combination with either a bag or an enclosure, either of which is preferably (although not necessarily) transparent, of special design for the hygienic and convenient catching, capturing and retaining of nails of humans and/or animals especially pets. The embodiments of the nail-catching and nail-capturing system are compatible with most presently available nail clippers and/or nail hygiene tools and nail-catching and nail-capturing bags and enclosures of various shapes and size.

14 Claims, 11 Drawing Sheets

HANDS TO FEET/PAWS TO CLAWS

REFERENCE TO RELATED APPLICATION

The present United States patent application is a nonprovisional utility patent application based upon my provisional United States utility patent application bearing U.S. Ser. No. 63/120,094 filed Dec. 1, 2020, which is hereby incorporated by reference in its entirety for purposes of priority.

FIELD

The present subject matter, directed in general to a nail clipper for humans, is more particularly directed to a nail dipping system, as characterized by the title.

Further in this regard, the present subject matter is directed to a novel clipped-nail catching-and-retaining system that includes, in present embodiments, an assortment of nail-catching bags or enclosures of various shapes, size and color, preferably transparent, designed for hygienic purposes and the convenience of the user, and for capturing clipped nails of humans as well as animals, particularly pets.

Still further, the present subject matter is compatible with most nail clippers and nail hygiene tools for humans and pets. Systems of the present subject matter include clipped-nail capturing bags or enclosures of various size to enclose human hands or feet—or fingers or toes—or animal claws, which I characterize as "paws."

BACKGROUND

Fingernail and toenail hygiene and maintenance is important to humans and animals. A lack of proper fingernail and toenail hygiene and maintenance in humans and associated nail and paw hygiene and maintenance in pets could result in a higher risk of acquiring disease due to germs and dirt that accumulate under nails.

Moreover, the care and maintenance of human toenails is crucial to avoid fungal development and associated infection that results from such development.

Furthermore, a lack of proper toenail hygiene and/or maintenance could result in a higher likelihood of developing ingrown toenails or similar complications. As a result, there is a need for human fingernail and toenail care and maintenance.

When it comes to pets, the maintenance of their claws is crucial for various reasons. For instance, aside from a hygiene and maintenance aspect, it is important to, and often preferred by, many pet owners that their pets have duller and shorter claws, so as not to accidentally damage special furniture such as leather couches or chairs, or not to accidentally scratch owners when playing or interacting with them. For animals, such possibilities can thus pose a further need for claw maintenance.

One of the biggest problems or inconveniences faced, when one performs a typical fingernail and/or toenail maintenance routine, is the "clippings" mess that results. For instance, one byproduct of fingernail and/or toenail maintenance are the "clippings," which typically consist of flying pieces of fingernails and/or toenails which may not be easy to find even when they land on a high color-contrast surface and which may be difficult to find when they land on a low color-contrast surface, where the term "color-contrast" shall be understood to mean the contrast in color between a color of a clipping and a color of a surface upon which the clippings land.

Also, it is well known that clippings may not simply fall vertically downward after a fingernail and/or toenail is cut, but rather can be jettisoned to unknown regions. Moreover, clippings are springy and can bounce off surfaces upon which they land. Therefore, typical trashcans and ordinary bags are not good options for efficiently collecting them, since it is very difficult to predict where such clippings will result. Thus, there is a need for a reliable and easy-to-use solution to the "clippings" mess problem or inconvenience resulting from performing fingernail and toenail maintenance routines on humans and paw maintenance on animals.

The US patent office was searched for prior art involving this field; and the prior art found was analyzed for possible solutions to the "clippings" mess problem.

For instance, U.S. Pat. No. 5,150,521 to Han, disclosing a nail collection box for a nail clipper, was found. While asserting that its "nail collection box can effectively collect clipped nail fragments and prevent the collected nail fragments from scattering," there is no structure disclosed that would, in fact, "effectively collect clipped nail fragments and prevent the collected nail fragments from scattering."

Also found was U.S. Pat. No. 5,459,926 to Perea which discloses a nail-clipping and nail-catching implement including a nail clipper having a forward end portion to sever nail fragments from a fingernail and a collector assembly fitted over the forward end portion. The collector assembly includes a collection receptacle having an interior collection chamber for catching and retaining the severed nail fragments and an elongated rod that is attached to, and extends between, opposite sides of the collection receptacle and that is coupled to the nail clipper forward end portion.

U.S. Pat. No. 5,632,288 to Webb, directed to a nail clippings catcher, discloses a catcher for nail clippings. While the '288 patent asserts its "catcher" is shaped to slip onto a "standard" nail clipper, it is unclear what a standard nail clipper is, since merchants sell an assortment of nail clippers that have different shapes and sizes.

U.S. Pat. No. 10,517,368 to Lyttle et al. discloses a nail clipping and collecting device that includes a housing and a clipper. The housing includes first and second actuation mechanisms. Also, the housing has an interior that encloses the clipper.

US published application 2011/0061668 to Saenim for nail trimming systems discloses a rectangular embodiment, and cylindrical embodiments, of an elongated receptacle that is attached to a nail-clipping end of a nail clipper of special design.

The complexity of the structures disclosed in these US patents and published application do not provide an easy-to-use solution to the problem or inconvenience noted above, and essentially prevent efficiently collecting all "clippings" produced.

Thus, there is still a need for a solution to the problem or inconvenience noted above, which efficiently collects essentially all "clippings" that are produced.

The present subject matter, presenting several embodiments of a reliable and easy-to-use solution to this problem or inconvenience, will now be summarized.

SUMMARY

The present subject matter—my present invention—is generally directed to a clipped nail-catching and nail-capturing system consisting essentially of a nail clipper in combination with a bag or enclosure, preferably transparent, of special design for hygienic and convenient catching-and-capturing of essentially all clipped finger and/or toe "nails"

of humans as well as the clipped paw "nails" of animals, especially pets. My use of the term "nails" throughout this patent specification shall refer to human fingernails and/or toenails and/or claw clippings from animal paws.

The present subject matter is compatible with most presently available nail clippers and/or nail hygiene tools. The present subject matter consists essentially of an assortment of my special designs for clipped nail-catching and nail-capturing bags or enclosures of various shapes, sizes, and color in combination with such nail clippers and/or nail hygiene tools. My use of the term "enclosure" throughout this patent application shall refer to a structure for containing substantially all clippings produced. Thus, an enclosure can take the form or shape of a shirt sleeve or pant leg in addition to an assortment of bags described below, and contain nail clippings.

In embodiments, a nail-catching and nail-capturing bag or enclosure for retaining substantially all such nail "clippings" has a first aperture or opening. The term "enclosure" as used herein shall be understood as a structure that resembles a shirt sleeve or a pant leg. The bag or enclosure includes an elastic band securely arranged about an edge margin of the aperture or opening in such a way so that the bag or enclosure fits around an animal paw and/or a human hand and/or a human foot in such a manner as to retain substantially all nail "cuttings" collected.

Embodiments of the present subject matter are exemplified by a variety of configurations and designs adaptable to specific sizes, materials, and applications.

The following sections of this patent specification shall be understood to describe the embodiments, components, configurations, variations, and/or other aspects of the present subject matter. Furthermore, any description, illustration, and/or disclosure, express or implied, shall be understood as my intent to explain my invention summarily or in detail, rather than to limit the scope of my invention.

In addition, the figures briefly described below are provided for the purpose of depicting present embodiments of my invention, and the detailed description below relating to those figures is not intended to limit the scope of my invention.

BRIEF DESCRIPTION OF THE DRAWING FIGURES

FIG. 1 is front elevational and perspective view of an embodiment of a clipped nail-catching and nail-capturing system that consists essentially of a nail clipper in combination with a bag, in accordance with the present subject matter.

FIG. 2, similar to the view of FIG. 1, depicts another embodiment of a bag.

FIG. 3, based on the view of FIG. 2, depicts another embodiment of a clipper.

FIG. 4 is a front elevational and perspective view of a double-bag system comprising a first bag embodiment of the present subject matter within a second bag, also of the present subject matter, sized to conveniently contain the first bag.

FIG. 5, a side elevational and perspective view, shows another second bag.

FIG. 6, yet another side elevational and perspective view, shows still another embodiment of the second bag, in accordance with the present subject matter.

Figure 10:
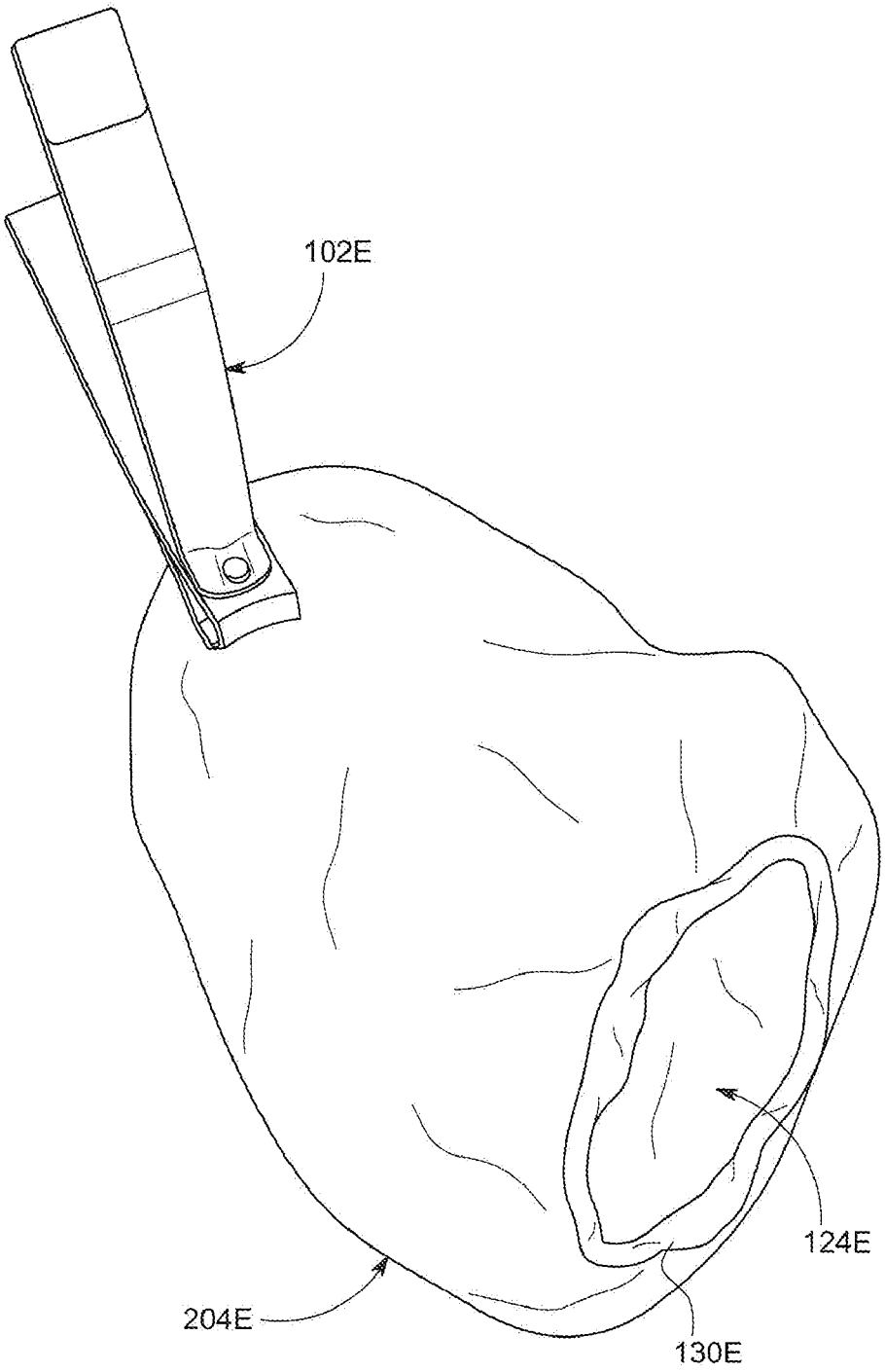

FIG. 10 presents a perspective view of an enclosure used in combination with a nail clipper, which is yet another embodiment of the present subject matter.

Figure 11:
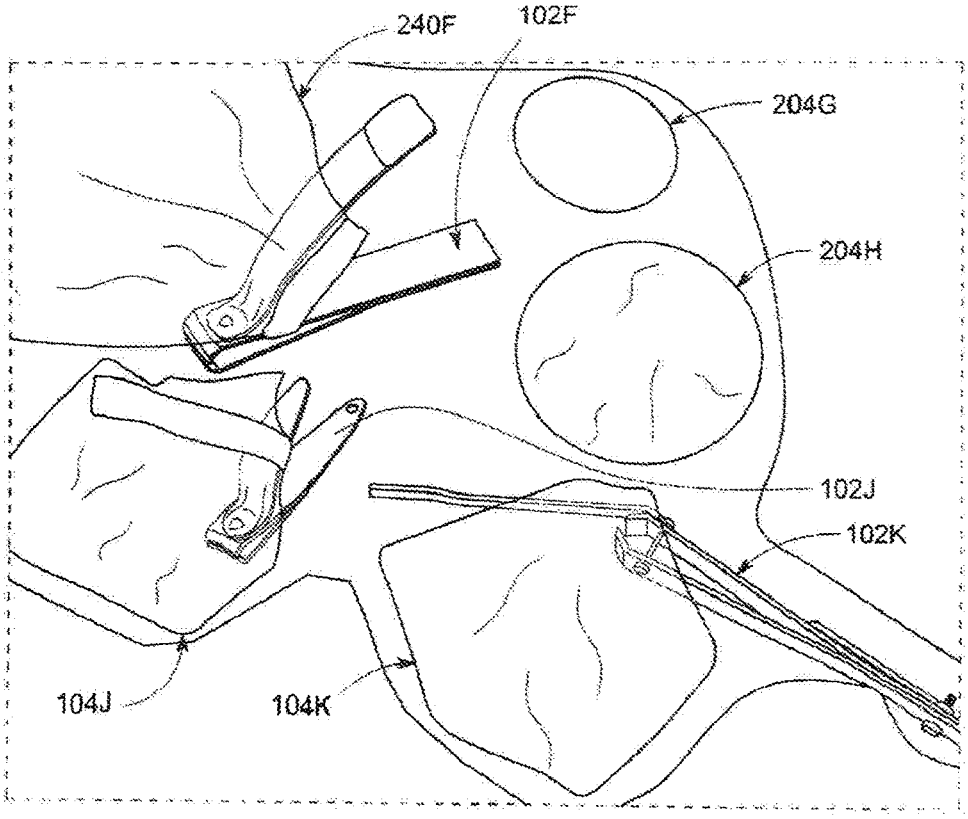

FIG. 11 is a plan view of a variety of plastic bags and enclosures, some of which are shown with nail clippers, in accordance with the present subject matter.

Throughout the drawing figures and detailed description, I shad use similar reference numerals to refer to similar components of the present subject matter.

DETAILED DESCRIPTION

Figure 1:
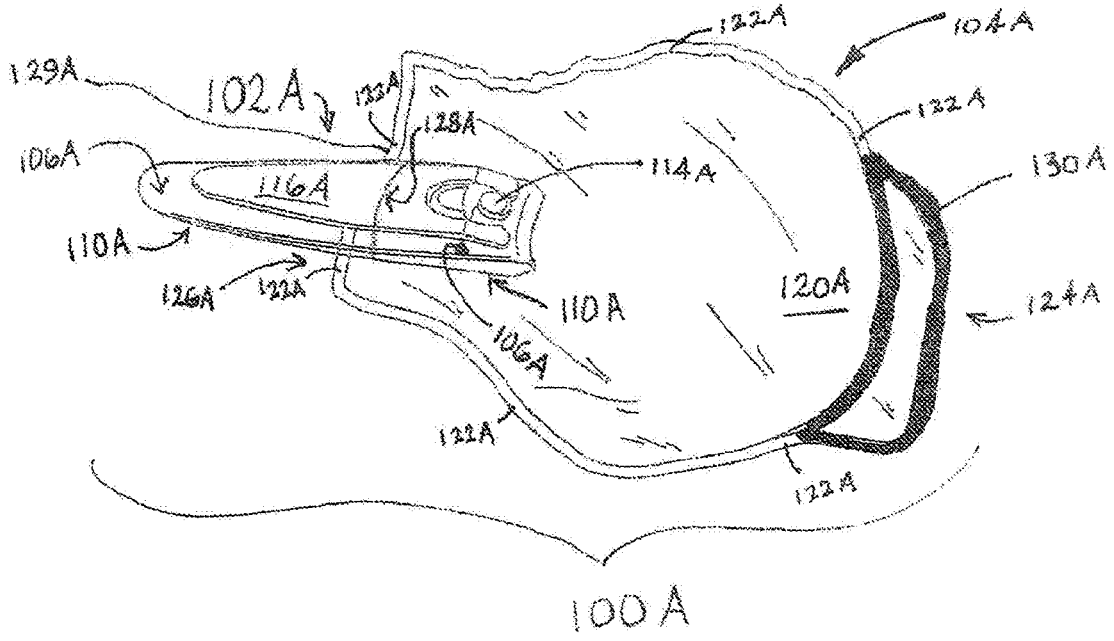

Referring to FIG. 1, the present subject matter—my present invention—is generally directed to a clipped nail-catching and nail-capturing system 100A consisting essentially of a nail clipper 102A in combination with a bag 104A. In additional embodiments, I shall describe a clipped nail-catching and nail-capturing system consisting essentially of a nail clipper in combination with an enclosure. The bag 104A, preferably transparent, is manufactured to be hygienic and conveniently sized for catching and capturing clipped nails of humans and animals such as pets. In embodiments, my bags are preferable manufactured from a relatively thin-film polymeric material—e.g., polyethylene or polypropylene—or a transparent fabric.

The clipped nail-catching and nail-capturing system of the present subject matter is compatible with most nail clippers and hygiene accessories now being sold. Examples of such nail hygiene accessories are disclosed in U.S. Pat. No. 5,249,674 to Lepie as well as in US published patent application 2020/0268137 to Lopiccolo, the disclosures of which are hereby incorporated by reference in their entireties.

Figure 2:
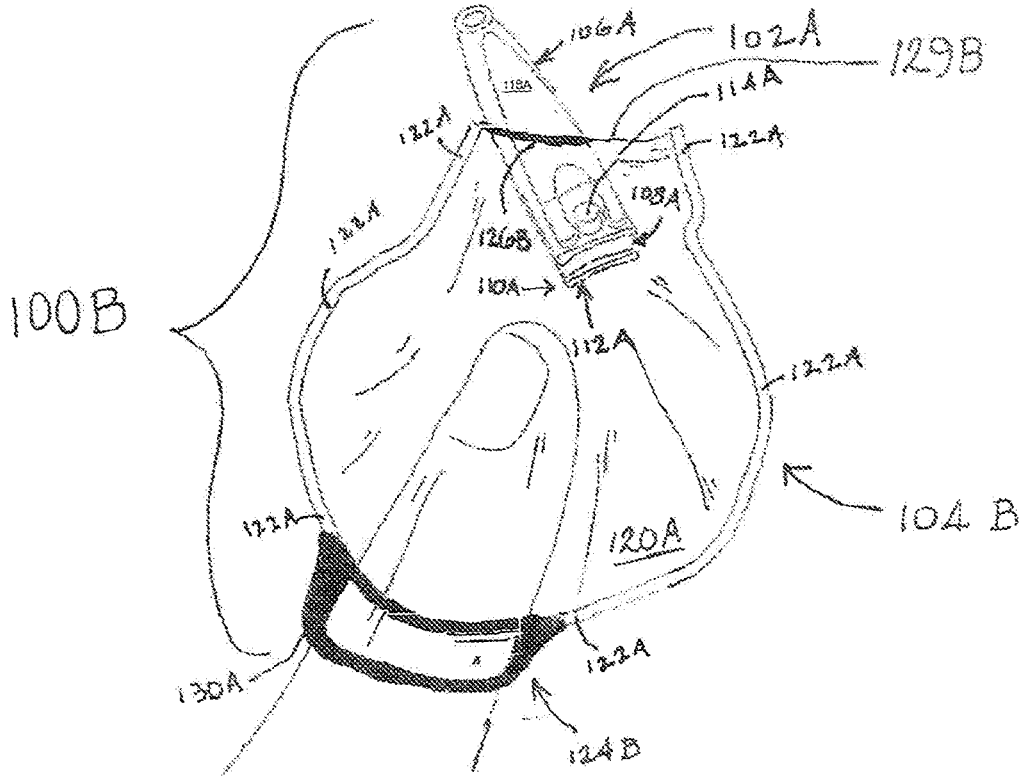

A compatible nail clipper 102A, shown in FIGS. 1 and 2, shall now briefly be described. The nail clipper 102A includes an elongated first or upper spring member 106A terminating in an upper or first cutting edge 108A (FIG. 2). The nail clipper 102A also includes a spring-biased (i.e., opposed) second or lower spring member 110A terminating in a lower or second cutting edge 112A (FIGS. 1 and 2). The nail clipper 102A further includes a pin 114A, located closely adjacent the first and second cutting edges 108A and 112A. The nail clipper 102A also includes a cam lever 116A, pivotally secured to the pin 114A, for enabling a person to depress the lever 116A and cause the first and second cutting edges 108A and 112A to clip nails. While operation of the nail dipper 102A is well known, U.S. Pat. No. 5,459,926 to Perea is hereby incorporated by reference in its entirety to confirm nail clipper operation and provide disclosure of other components of a compatible nail clipper.

Exemplary embodiments of the clipped nail-catching and nail-capturing bags of the present subject matter as shown in my figures will now be described in detail.

The exemplary bag 104A shown in FIG. 1 includes a first sidewall 120A and a second sidewall spaced behind the first sidewall 120A, Bag 104A includes edge portions 122A where edge margins of first and second sidewalls are joined together in a fluid-tight manner by known methods including but not limited to heat sealing, adhesively sealing, etc. The bag 104A further includes a first orifice or opening 124A dimensioned for enabling a person to insert a finger or a toe and/or an animal to insert a paw into an interior region located between the first and second sidewalls.

The exemplary bag 104B shown in FIG. 2 includes a second orifice or opening 126B located spaced from the first orifice or opening 124B. The second orifice or opening 126B is configured to allow operative end portions of the first and second spring members 106A and 110A and cam lever 116A of the nail clipper 102A to extend outwardly while the first and second cutting edges 108A and 112A are located within the interior region that is between the first and second sidewalls.

In comparison, the exemplary bag 104A shown in FIG. 1 also includes a second orifice or opening 126A and further includes a third orifice or opening 128A, both being located spaced from the first orifice or opening 124A. The second orifice or opening 126B is configured to allow operative end portions of the first and second spring members 106A and 110A of nail clipper 102A to extend outwardly. The third orifice or opening 128A is configured to allow the cam lever 116A of the nail clipper 102A to also extend outwardly, when the first and second cutting edges 108A and 112A are within the interior region. Bag 104B has an edge margin 129B opposite its first orifice or opening 124B; and bag 104A similarly has an edge margin 129A opposite its first orifice or opening 124A. Note that while the second orifice or opening 126B for bag 104B is located along a lateral edge portion of its edge margin 129B, the second and third orifices or openings 126A and 128A, described above for bag 104A, are approximately centrally located along edge margin 129A.

Both of the exemplary bags 104A and 104B shown in FIGS. 1 and 2 have an elastic band 130A secured to a perimeter of first orifice or opening 124A and 124B. In embodiments, the elastic band 130A is shaped, sized, and dimensioned to snugly encircle a human finger (FIG. 2), human toe, and/or an animal paw inserted via the orifice or opening 124A, 124B into the interior region for nail clipping purposes, so that substantially all nail clippings remain in the illustrated bags 104A, 104B (shown in FIGS. 1 and 2) between their respective first and second sidewalls.

In the following detailed description, I shall now describe in detail additional aspects or features of the present subject matter—my invention—for purposes of providing a complete disclosure. For instance, in embodiments, such as the clipped nail-catching and nail-capturing bag 104B shown in FIG. 2, the interior region located between the first and second sidewalls is dimensioned to permit a slightly larger-sized compatible nail clipper 102B (FIG. 3) to be used in combination with the clipped nail-catching and nail-capturing bags of the present subject matter.

Figure 4:
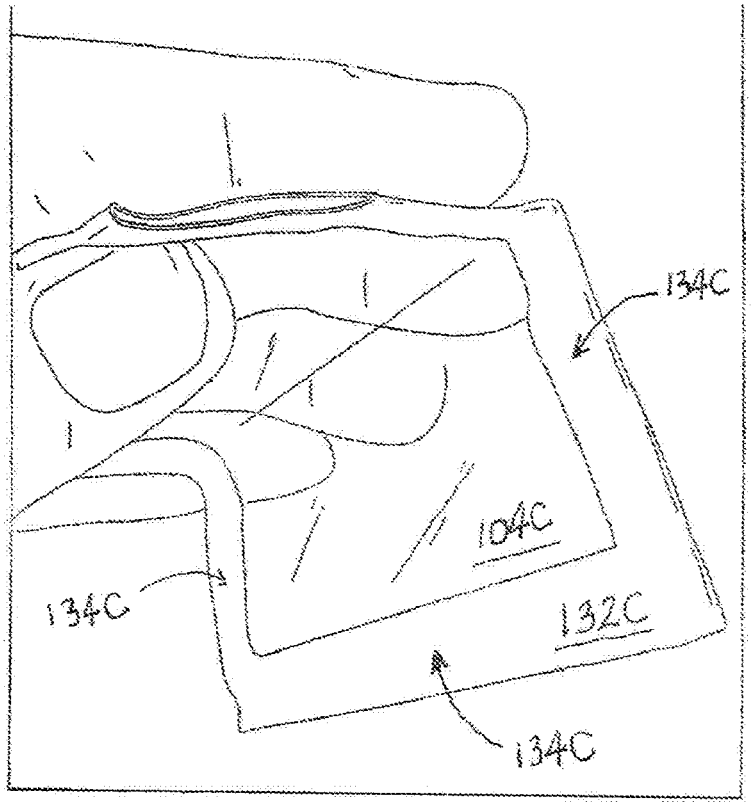

Another embodiment of the present subject matter is a double-bag system consisting of another embodiment of the clipped nail-catching and nail-capturing bag 104C within a second bag 132C, as shown in FIG. 4. In this embodiment, there is a second interior region 134C, which is located between the bags 104C and 132C.

Figure 5:
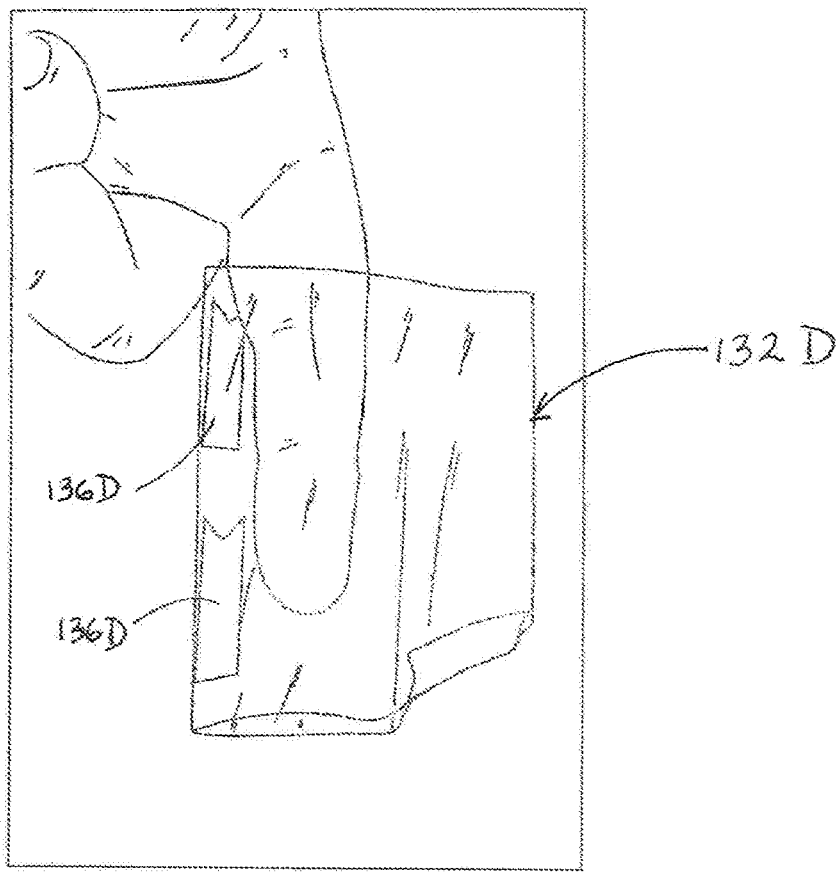
Figure 6:
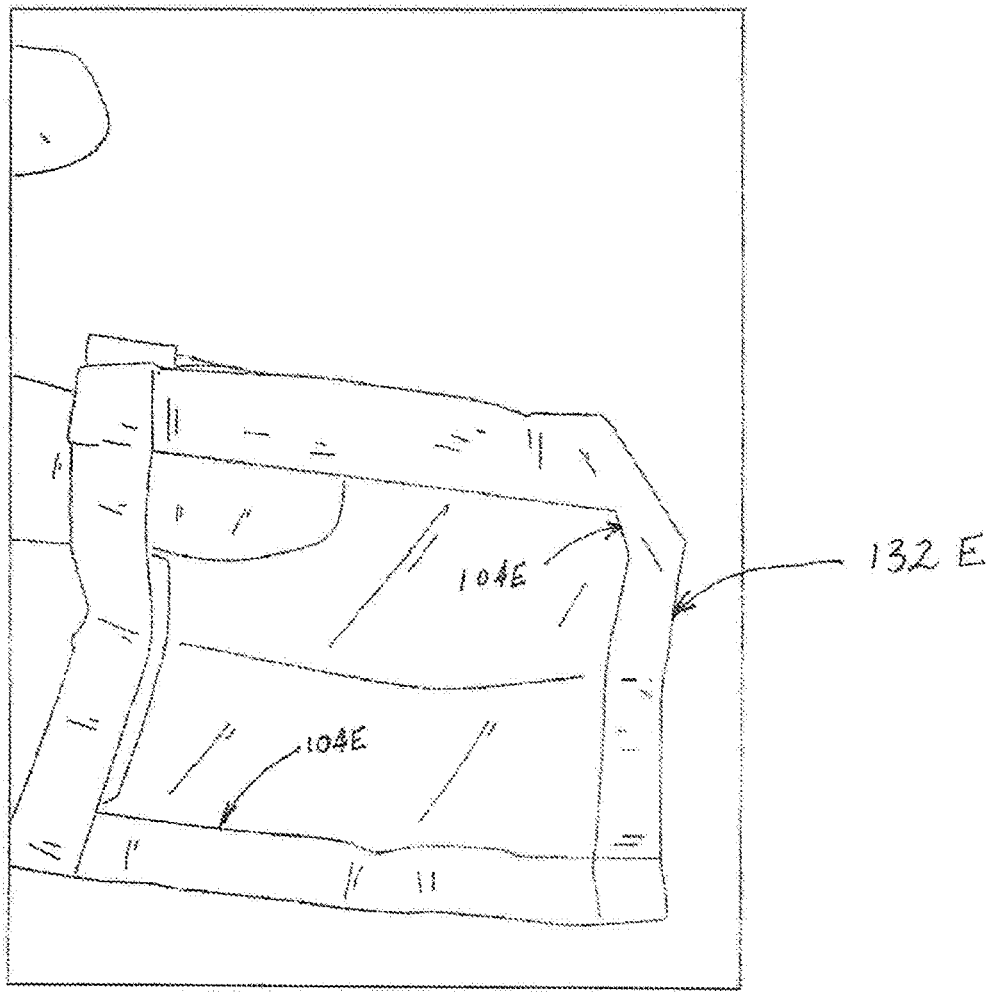

Moreover, other second bag embodiments, such as the second bag 132D shown in FIG. 5 and the second bag 132E shown in FIG. 6 can be manufactured to have additional sidewalls, unitary with their first and second sidewalls, so that the bags 132D and 132E are made according to a well known or "common") design.

A bag of such design (described as follows) comprises a first sidewall and a second sidewall spaced from the first sidewall. The bag includes an interior region between the first and second sidewalls. The bag also includes a third sidewall joined, preferably in a unitary manner, to each one of the first and second sidewalls. The bag further includes a fourth sidewall spaced from the third sidewall. The fourth sidewall is also joined, preferably in a unitary manner, to each one of the first and second sidewalls. The third sidewall includes spaced-apart edge margins along which each one of the first and second sidewalls is joined, preferably in a fluid-tight manner. The fourth sidewall also includes spaced-apart edge margins along which each one of the first and second sidewalls is joined, preferably in a fluid-tight manner. The bag has a bottom wall (or simply a "bottom") joined to each of the first, second, third, and fourth sidewalls, preferably in a fluid-tight manner.

In accordance with the present subject matter, four-walled embodiments are dimensioned, for purposes of enabling still other first bag embodiments (of a two-bag system), such as the dipped nail-catching and nail-capturing bag 104E (FIG. 6), to conveniently fit within the four-wall second bag 132E. In addition, first bag embodiments can also be manufactured to have similar additional sidewalls, unitary with their first and second sidewalls, to provide extra volume (or "space") for humans or pets requiring extra volume, whenever such extra "space" is desired.

Further in accordance with the present subject matter, still other second bag embodiments of the present subject matter, such as the second bag 132D shown in FIG. 5 can include sidewall regions 136D where indicia (e.g., advertising tag lines, trademarks, and such) can appear on an interior surface or on an exterior surface, to inform a user of the source of second bags, when it is time to buy more.

Figure 3:
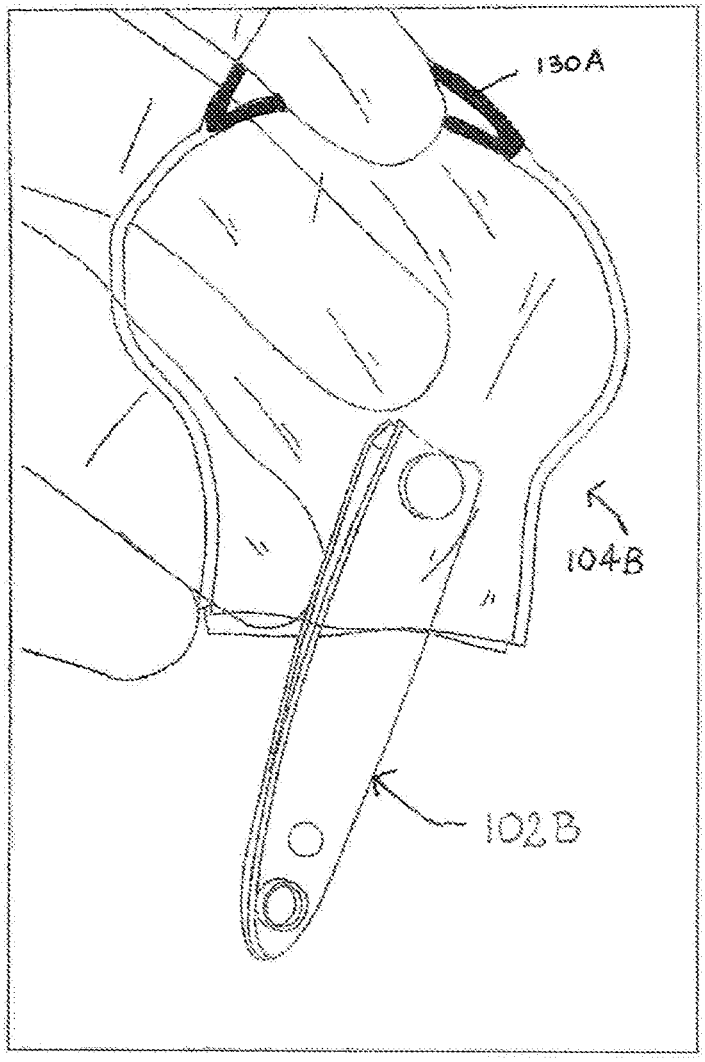

Also, the dipped nail-catching and nail-capturing bags of the present subject matter can be manufactured to have an assortment of shapes and sizes including but not limited to clamshell-shaped bags 104A and 104B shown in FIGS. 1-3 as well as the square-shaped and/or rectangular-shaped bag 104C that is shown in FIG. 4.

Figure 7:
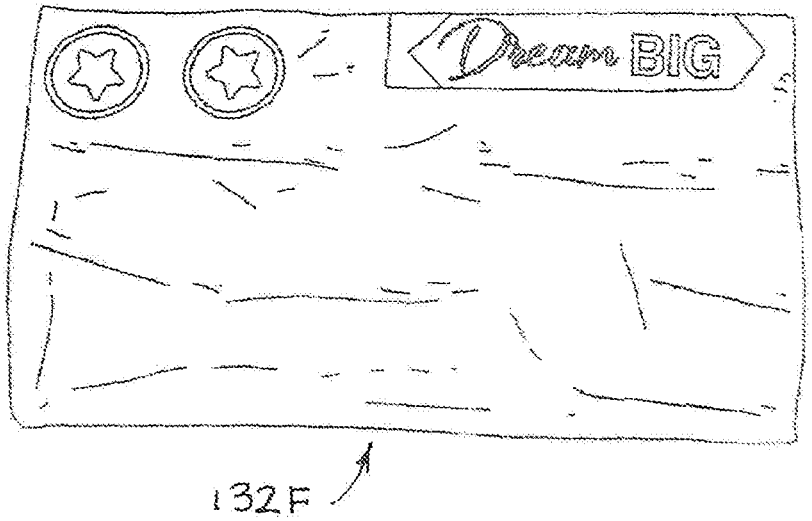
FIG. 7 is a frontal view of an additional embodiment of the second bag.

Furthermore, still other second bag embodiments, such as the second bag 132F shown in FIG. 7, can be dimensioned for purposes of containing a plurality of the dipped nail-catching and nail-capturing bags of the present subject matter (not shown), all conveniently contained within the second bag 132F, which will be appreciated by professionals scheduled to service clients having nail clipping needs.

Figure 8:
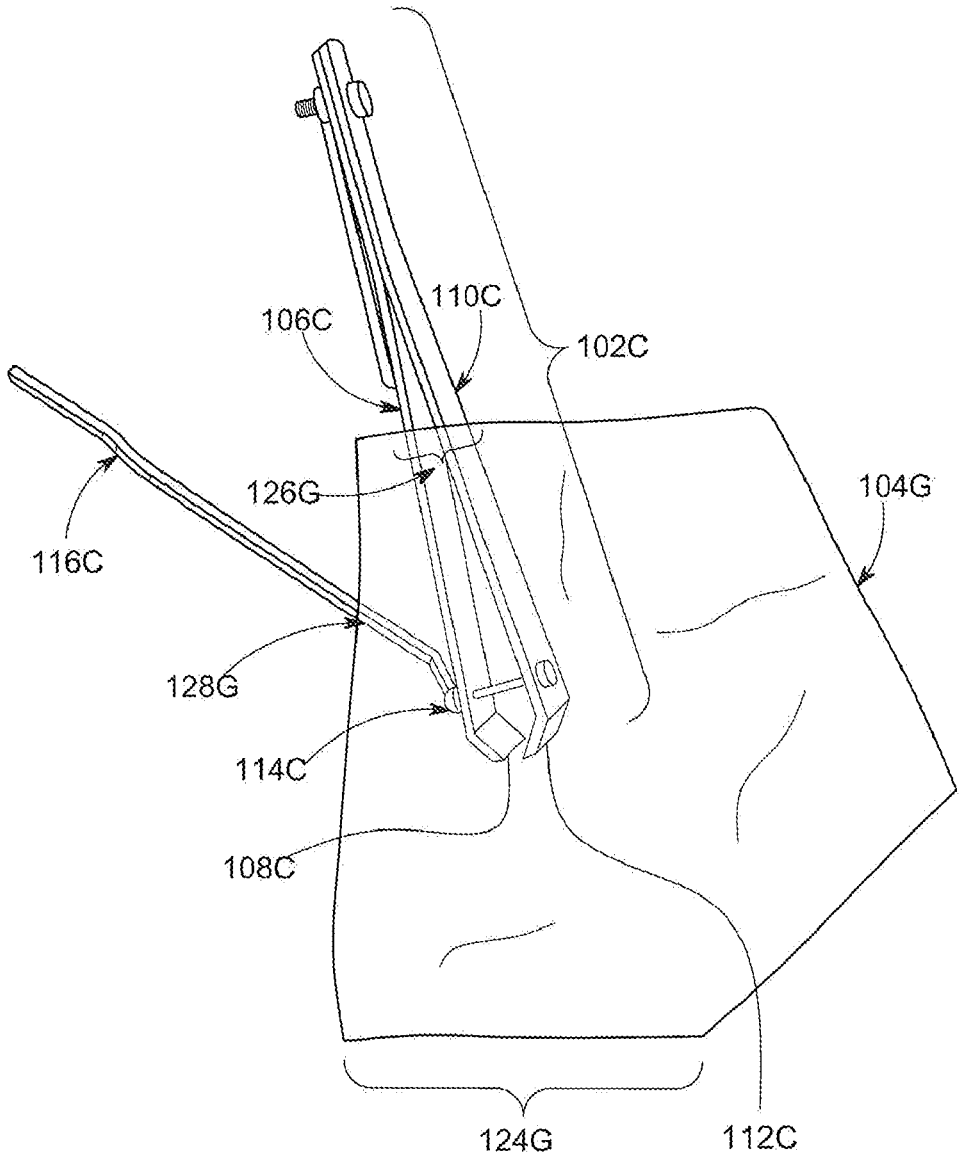
FIG. 8 is a plan view of another embodiment of a clear plastic first bag.

Referring next to FIG. 8, yet another compatible nail clipper 102C shall now briefly be described. The nail clipper 102C includes an elongated first or upper spring member 106C terminating in an upper or first cutting edge 108C. The nail clipper 102C further includes a spring-biased (i.e., opposed) second or lower spring member 110C terminating in a lower or second cutting edge 112C. The nail clipper 102C further includes a pin 114C, located close to the first and second cutting edges 108C and 112C. The nail clipper 102C also includes a cam lever 116C, pivotally secured to the pin 114C, for enabling a person to depress the lever 116C and cause the first and second cutting edges 108C and 112C to clip nails. The nail clipper 102C is used in combination with yet another embodiment of a first or inner bag 104G which includes a first aperture or opening 124G sized for inserting one finger, several fingers, or a portion of a human palm into the bag 104G which includes a second aperture or opening 126G configured to allow the operative end portions of the first and second spring members 106C and 110C of clipper 102C to extend outwardly. The bag 104G also includes a third orifice or opening 128G configured to allow the cam lever 116C of the nail clipper 102C to also extend outwardly, when the first and second cutting edges 108C and 112C are within the interior region. The embodiment shown in FIG. 8 is a five-sided bag 104G, also made of clear plastic.

Figure 9:
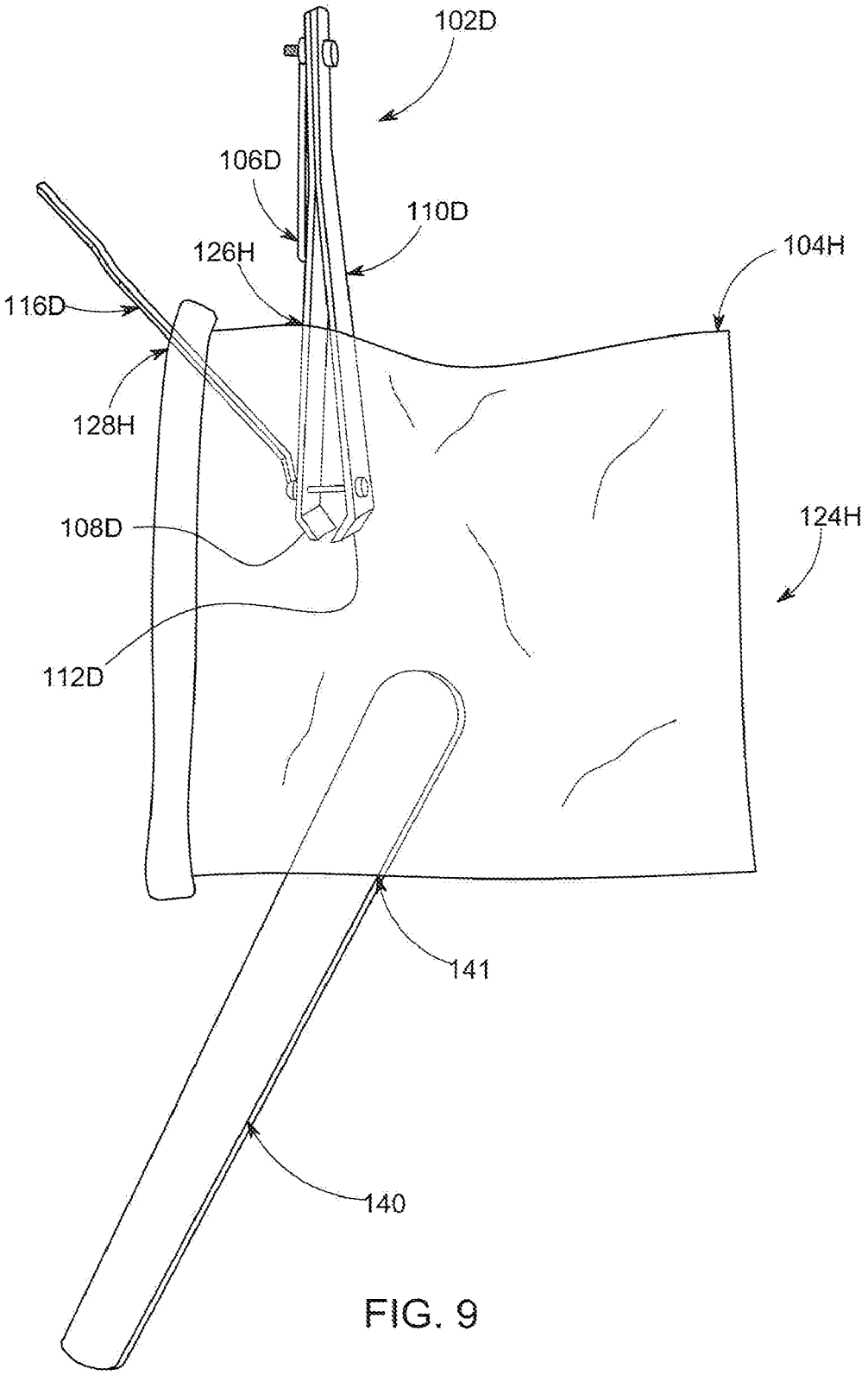
FIG. 9 is a plan view of still another embodiment of a clear plastic first bag.

Briefly referring to FIG. 9, another compatible nail clipper 102D includes an elongated first or upper spring member 106D terminating in an upper or first cutting edge 108D. Nail clipper 102D also includes a spring-biased second or lower spring member 110D terminating in a lower or second cutting edge 112D. Nail clipper 104D further includes a cam lever 116D, for enabling a person to depress lever 116D toward the upper spring member 106D, for causing the first and second cutting edges 108D, 112D to clip nails. The nail clipper 102D is used in combination with yet another embodiment of a first or inner bag 104H which also includes a first aperture or opening 124H sized for inserting one of more fingers, or a portion of a palm of a child, into bag 104H which also has a second aperture or opening 126H configured to allow operative end portions of the first and second spring members 106D, 110D of clipper 102D to extend outwardly. The bag 104H also includes a third orifice or opening 128H configured to allow the cam lever 116D of the clipper 102D to extend outwardly, when the cutting edges 108D, 112D are within the interior region. The embodiment that is shown in FIG. 9 further includes a nail file 140—which is a small file used, e.g., for trimming fingernails or for smoothing rough fingernail edges. This embodiment of the bag 104H includes a fourth aperture, orifice, or opening 141 through a sidewall, for enabling the nail file 140 to be partially inserted into the interior of bag 104H, to enable nail hygiene procedures.

FIG. 10 presents yet another embodiment of the present subject matter, namely, an enclosure 204E, preferably made of clear plastic and resembling a shirt or blouse sleeve, or a pant leg. The enclosure 204E is used in combination with a nail clipper 102E or nail hygienic tool (not shown) in accordance with the present subject matter. The enclosure 204E includes a first opening or aperture 124E, and an elastic band 130E secured to the perimeter of the first opening or aperture 124E. The elastic band 130E is shaped and dimensioned to snugly encircle one of more fingers, or a portion of the palm of a child, or an animal paw inserted via the first orifice or opening 124E into the interior region of enclosure 204E for nail clipping purposes, so that substantially all nail clippings remain within the enclosure 204E.

FIG. 11 presents a variety of plastic bags and enclosures, some of which are shown with nail clippers, in accordance with the present subject matter. For instance, the illustrated first or inner bags 104J and 104K are each shown with an associated nail clipper 102J and 102K. As noted, bags and enclosures of the present subject matter are sized for an assortment of nail-cutting requirements. For instance, enclosure 204F is sized larger, and enclosures 204G and 204H are smaller.

Enclosures of the present subject matter can be sized to resemble a trouser leg, enabling a person to insert a leg through a first opening, so that the toenails of such person can be trimmed by another, using the nail clipper end portions that extend through at least one other opening of the enclosure. The enclosures of the present subject matter can also be sized to resemble a blouse or shirt sleeve. Elastic secured to the first opening would be sized to closely seal around a palm, forearm, or upper arm of a person, to retain substantially all nail clippings produced. Such enclosures, of various colors, can be made of a plastic material or a rigid material.

The title "hands to feet/paws to claws" involves a hygienic nail care program for fingers and toes of humans and claws of animals such as pets. Such a program utilizes a bag or enclosure, preferably (but not necessarily) transparent, having openings for human fingers and/or toes, or for paws of animals such as pets. Also, the bags and/or enclosures are made to hold nail dippers and trimmers in place while another person performs the task of dipping the nails of a person, finger by finger, with the bag or enclosure retaining substantially all such clippings produced.

Described and illustrated in this patent application is a dipped nail-catching and nail-capturing system consisting essentially of a nail dipper in combination with either a bag or an enclosure, each of which is preferably transparent, of special design for hygienic and convenient catching and capturing of clipped fingernails and/or toenails of humans and/or claw clippings of animals especially pets. While the present subject matter has been illustrated and described with reference to exemplary embodiments, the present subject matter is not to be limited to these examples and/or embodiments. On the contrary, many alternatives, changes, and/or modifications will become apparent to those of ordinary skill in the field of the present subject matter after this document is read. As a result, all such alternatives, changes, and/or modifications are to be treated as part of the present subject matter insofar as they fall within the spirit and scope of claims that follow.

I claim:

1. A clipped nail-catching and nail-capturing system consisting essentially of a nail clipper in combination with a bag, wherein the bag comprises a first sidewall and a second sidewall, wherein the first and second sidewalls define an interior region therebetween and edge margins joined together in a fluid-tight manner, wherein the bag defines a first opening dimensioned to allow a person to insert a finger or a toe or an animal to insert a paw into the interior region, wherein the nail clipper includes a first end configured for clipping nails and a second end and a third end, both the second end and the third end being spaced from the first end and being operatively joined for causing the first end to clip nails, wherein the bag also defines a second opening through which the first end of the nail clipper is disposed into the interior region and from which one of the second and third ends of the nail clipper extends, wherein the bag further defines a third opening through which the other of the second and third ends of the nail clipper extends, and wherein the bag includes an elastic band secured to a perimeter of the first opening in a manner such that substantially all nail clippings remain within the bag.

2. The clipped nail-catching and nail-capturing system of claim 1, wherein the second sidewall is located adjacent the first sidewall.

3. The clipped nail-catching and nail-capturing system of claim 1, wherein the second sidewall is spaced from the first sidewall.

4. The clipped nail-catching and nail-capturing system of claim 1, wherein the second opening is spaced from the first opening.

5. The clipped nail-catching and nail-capturing system of claim 1, wherein the third opening is spaced from the first opening.

6. A clipped nail-catching and nail-capturing system that consists essentially of a nail clipper in combination with a first bag, wherein the nail clipper in combination with the first bag are both contained within a second bag, wherein the first and second bags each comprise a first sidewall and a second sidewall, wherein the first and second sidewalls of each respective one of the first and second bags defines an associated interior region located therebetween, wherein the first bag defines a first opening dimensioned to allow a person to insert a finger or a toe or an animal to insert a paw into the interior region, wherein the nail clipper includes a first end configured for clipping nails and a second end spaced from the first end for causing the first end to clip nails, wherein the first bag further defines a second opening through which the first end of the nail clipper is disposed into the interior region of the first bag and from which the second end of the nail clipper extends from the first bag, and wherein the first bag includes an elastic band secured to a perimeter of the first opening in a manner such that substantially all nail clippings remain within the first bag.

7. The clipped nail-catching and nail-capturing system of claim 6, wherein the second sidewall of the first bag is located adjacent the first sidewall.

8. The clipped nail-catching and nail-capturing system of claim 6, wherein the second opening of the first bag is spaced from the first opening.

9. The clipped nail-catching and nail-capturing system of claim 6, wherein a surface of the second bag includes indicia that is indicative of source, wherein the indicia comprise an advertising tag line and/or a trademark.

10. The clipped nail-catching and nail-capturing system of claim 6, wherein the second sidewall of the second bag is spaced from the first sidewall, wherein the second bag includes a third sidewall having a first edge margin that is unitary with the first wall and a second edge margin that is unitary with the second wall, wherein the second bag further includes a fourth sidewall spaced from the third sidewall, wherein the fourth sidewall has a first edge margin that is unitary with the first wall and a second edge margin that is unitary with the second wall.

11. The clipped nail-catching and nail-capturing system of claim 10, wherein the second sidewall of the first bag is spaced from the first sidewall, wherein the first bag includes a third sidewall having a first edge margin that is unitary with the first wall and a second edge margin that is unitary with the second wall, wherein the first bag further includes a fourth sidewall spaced from the third sidewall, and wherein the fourth sidewall has a first edge margin that is unitary with the first wall and a second edge margin that is unitary with the second wall.

12. The clipped nail-catching and nail-capturing system of claim 11, wherein each one of the first and second bags has a bottom that is joined to each one of the first, second, third, and fourth sidewalls that are associated therewith.

13. The clipped nail-catching and nail-capturing system of claim 12, wherein a surface of the second bag includes indicia indicative of source, wherein the indicia comprise an advertising tag line and/or a trademark.

14. The clipped nail-catching and nail-capturing system of claim 13, wherein the surface of the second bag that includes indicia is an exterior surface, wherein the indicia comprise an advertising tag line and/or a trademark.

* * * * *